US006900391B1

(12) United States Patent
Maeda

(10) Patent No.: US 6,900,391 B1
(45) Date of Patent: May 31, 2005

(54) ELECTRIC WIRE FOR AUTOMOBILE

(75) Inventor: Koutarou Maeda, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 10/959,127

(22) Filed: Oct. 7, 2004

(30) Foreign Application Priority Data

Jul. 15, 2004 (JP) ..... 2004-208330

(51) Int. Cl.[7] ..... H01B 5/08
(52) U.S. Cl. ..... 174/128.1; 174/128.2
(58) Field of Search ..... 174/128.1, 128.2, 174/126.1, 121 A

(56) References Cited

FOREIGN PATENT DOCUMENTS

EP 0 331 182 * 9/1989
JP A 1-225006 9/1989
JP 01225006 * 9/1989

* cited by examiner

*Primary Examiner*—Chau N. Nguyen
(74) *Attorney, Agent, or Firm*—Oliff & Berridge, PLC

(57) ABSTRACT

An electric wire for automobile including a compressed conductor which is obtained by arranging around a single central element wire of stainless steel, seven or more peripheral element wires of copper or copper alloy in a single circle in tight adherence with each other, and an insulation coating layer which covers the outer circumference of the conductor, wherein the diameter of the central element wire is larger than the diameters of the peripheral element wires, the cross sectional area of the conductor is 0.13 through 0.16 $mm^2$, and the insulation coating layer contains a fire retardant in the amount of 160 weight parts or more relative to 100 weights parts of insulation polymer.

2 Claims, 3 Drawing Sheets

ELECTRIC WIRE FOR AUTOMOBILE

CROSS REFERENCE TO RELATED APPLICATION

The invention claims priority to Japanese Patent Application No. 2004-208330 filed on Jul. 15, 2004. The disclosure of the prior application is incorporated herein by reference in its entirety.

BACKGROUND OF THE INVENTION

1. Field of Invention

The invention relates to an electric wire for automobile. More particularly, it relates to an electric wire for automobile which meets the demand for an improved tensile strength and a smaller diameter.

2. Description of Related Art

An automobile uses a wire harness, which is a bundle of many electric wires, for electric connection with electrical equipment. Some of electric wires used in a wire harness include conductors having a twisted wire structure, which is obtained by twisting a plurality of element wires. FIG. 1 shows a typical conductor (element wire aggregate) included in this type of wire. In FIG. 1, denoted at 1 is the conductor having a twisted wire structure in which six peripheral element wires 3 are arranged around a single central element wire 2 in a single circle in tight adherence with each other and twisted. So far, in general, copper or copper alloy has been used as the central element wire 2 and the peripheral element wires 3, which form the conductor in such a twisted wire structure. Further, the diameters of the central element wire 2 and the peripheral element wires 3 are customarily the same. As a further general aspect, the nominal cross sectional area of the conductor is approximately 0.35 $mm^2$.

Meanwhile, the recent years have seen an increasing demand to an electric wire for automobile for an improved tensile strength and a smaller diameter. However, in the case of the electric wire shown in FIG. 1, it is necessary to increase the diameter of the conductor to improve in tensile strength, which contradicts the demand for a smaller diameter.

In light of this, an object of the invention is to provide an electric wire for automobile which realizes a better tensile strength when the diameter of a conductor remains unchanged, maintains a tensile strength comparable to that of a conventional electric wire for automobile even when the diameter of the conductor is reduced, and achieves an equally favorable or better tensile strength than that of a conventional electric wire for automobile depending upon how thin the diameter of the conductor has been reduced.

As a result of intensive researches, it is possible to improve a tensile strength when stainless steel is used as a central element wire, that it is possible to realize diameter reduction while further improving the tensile strength when the diameter of the central element wire is made larger than the diameters of peripheral element wires. Further, when stainless steel, which exhibits a lower conductivity than copper or copper alloy, is used as the central element wire, the heat generation problem, i.e., combustion of the wire caused by the heat generated in the wire, is prevented as the amount of a fire retardant is set in a proper range.

SUMMARY OF THE INVENTION

Various exemplary embodiments of the invention are directed to an electric wire for automobile including a compressed conductor which is obtained by arranging around a single central element wire of stainless steel seven or more peripheral element wires of copper or copper alloy in a single circle in tight adherence with each other; and an insulation coating layer which covers the outer circumference of the conductor, wherein the diameter of the central element wire is larger than the diameters of the peripheral element wires, the cross sectional area of the conductor is 0.13 through 0.16 $mm^2$, and the insulation coating layer contains a fire retardant in the amount of 160 weight parts or more relative to 100 weight parts of insulation polymer.

BRIEF DESCRIPTION OF THE DRAWINGS

The accompanying drawings, which are incorporated with and constitute a part of the specification, illustrate one or more embodiments of the invention, and taken with the detailed description, serve to explain the principles and implementations of the invention.

In the drawings.

DETAILED DESCRIPTION OF PREFERRED EMBODIMENTS

Figure 1:
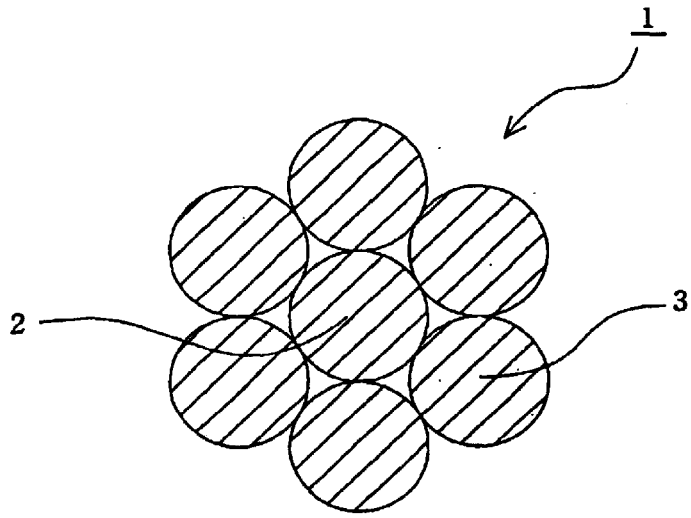
Fig. 1 (PRIOR ART)
FIG. 1 is a cross sectional view of an electric wire for automobile having a conventional twisted wire structure (non-compressed conductor).

According to the invention, because stainless steel is used as a central element wire, it is possible to obtain a better tensile strength than that of a conventional electric wire, which uses copper or copper alloy for this purpose.

Further, because a compressed conductor is used as a conductor, which is comprised of the central element wire and peripheral element wires, it is possible to efficiently reduce the diameter of the conductor.

When the cross sectional area of the conductor is too small, it is not possible to attain a sufficient tensile strength despite use of stainless steel as the central element wire, while when the cross sectional area is too large, it is not possible to meet the demand for a smaller diameter, and rather, the flexibility may deteriorate. Considering this, the cross sectional area of the conductor is preferably 0.13 through 0.16 $mm^2$.

According to various exemplary embodiments of the invention, because the diameter of the central element wire is larger than the diameters of the peripheral element wires, an electric wire comprising a conductor whose cross sectional area is 0.13 through 0.16 $mm^2$ has a satisfactory tensile strength.

On the other hand, because stainless steel having lower thermal conductivity than copper and copper alloy is used as the central element wire, a problem of heat removal is apt to occur. Based on an experiment, it has been found that reducing the diameter of conductor, the required amount of fire retardant in an insulation coating layer increase abruptly. It is supposed that, when the diameter of conductor is reduced and thickness of the insulation coating layer remains same, the surface area relative to the unit volume of the insulation coating layer becomes large and oxygen supply increases, whereby the required amount of fire retardant increases.

Based on this fact, studies have been conducted regarding the required amount of fire retardant and found the earlier mentioned amount. That is, even when the cross sectional area of the conductor is 0.13 through 0.16 $mm^2$, if the insulation coating layer contains a fire retardant in the amount of 160 weight parts or more relative to 100 weight parts of insulation polymer, i.e., the earlier mentioned range, highly reliable coated electric wire can be obtained.

According to various exemplary embodiments of the invention, because the peripheral element wires are arranged in a single circle around the central element wire, the peripheral element wires are arranged stably relative to the central element wire.

In the event that diameter reduction is maximum while considering a tensile strength, an impact load and flexibility, the most practical and desirable cross sectional area of the conductor is the nominal cross sectional area of 0.13 $mm^2$.

Various preferred embodiments are directed to the electric wire for automobile according to various exemplary embodiments of the invention, wherein the cross sectional area of the conductor is the nominal cross sectional area of 0.13 $mm^2$.

Figure 2:
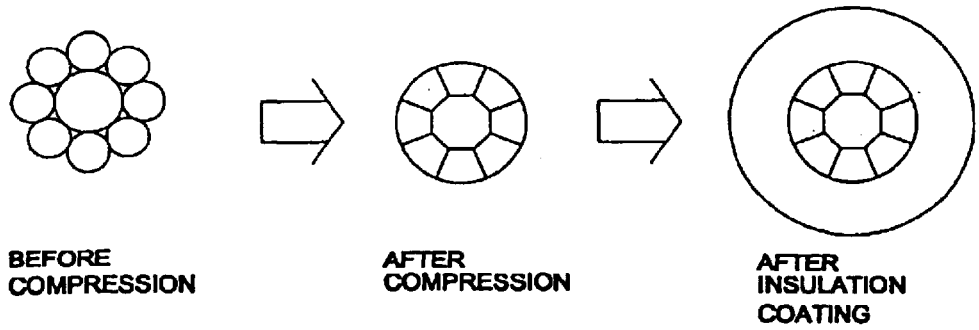
FIG. 2 is cross sectional views which show the state before compression, the state after compression and the state after insulation coating of an example of electric wire for automobile according to the invention.
Figure 3:
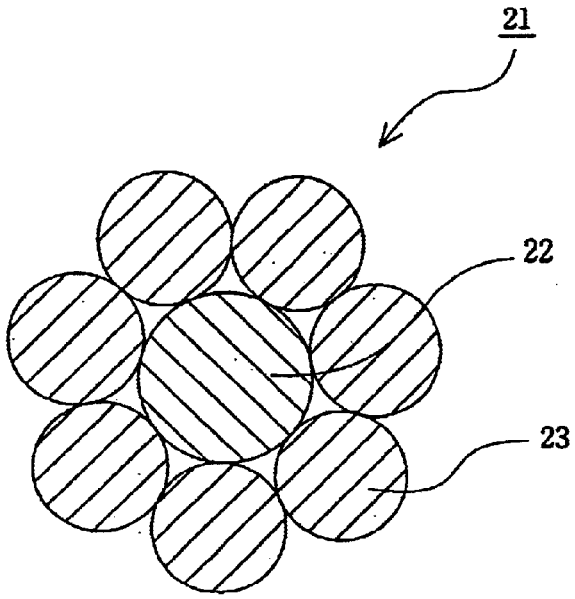
FIG. 3 is a cross sectional view which shows the state of the electric wire for automobile according to the invention before compression.

FIG. 2 is a cross sectional view showing the state of the conductor before compression, after compression and after insulation coating of an electric wire for automobile according to various exemplary embodiments of the invention, and showing an example of structure that eight peripheral element wires are used. FIG. 3 is a cross sectional view showing the state of the conductor before compression, and showing an example of structure that seven peripheral element wires are used.

In FIG. 3, denoted at 21 is the conductor before compression (element wire aggregate) having a twisted wire structure that around a single central element wire 22 of stainless steel, seven peripheral element wires 23 of copper or copper alloy are arranged in a single circle in tight adherence with each other and twisted together. The diameter of the central element wire 22 is set larger than the diameters of the peripheral element wires 23. Using compression dies or the like for instance, such an element wire aggregate is compressed in the directions toward the center and turned into a compressed conductor. An insulation coating is disposed around the compressed conductor directly or through a shield layer, thereby obtaining an electric wire for automobile.

While the conventional electric wire for automobile shown in FIG. 1 has a structure that six peripheral element wires are arranged in a single circle in tight adherence with each other around the central element wire, in the electric wire for automobile in various exemplary embodiments of the invention, in order to set the diameter of the central element wire larger than the diameters of the peripheral element wires, the number of the peripheral element wires is seven or more. Although the number of the peripheral element wires may be any desired number as long as there are seven or more peripheral element wires, the number of the peripheral element wires is more preferably seven through ten, and particularly preferably eight, from a standpoint of productivity.

While various types of stainless steel may be used as the central element wire of the electric wire for automobile according to the invention, it is desirable to use SUS 304, SUS 316 (both defined in Japanese Industrial Standards) or the like which exhibit particularly large tensile strengths.

Further, while various types of copper or copper alloy may be used as the peripheral element wires, considering conductivity, tensile strength, elongation, etc., it is desirable to use pure copper, Cu—Ni—Si alloy, Cu—Sn alloy, Cu—Cr—Zr alloy or the like.

Considering use of the electric wire for automobile according to the invention as an electric wire for wire harness, the tensile breaking load of the conductor is preferably 62.5 N or more. Meanwhile, the terminal fixing power is preferably 50 N or more.

Next, to obtain a proper range for the amount of the fire retardant, a relationship between the cross sectional area of the conductor and a required amount of the fire retardant is identified.

First, the relationship between the cross sectional area of the conductor and the required amount of the fire retardant was studied on a conventional electric wire which is shown in FIG. 1.

The experiment used an electric wire made of pure copper having the cross sectional area of 0.14 through 0.51 $mm^2$ and the tensile fracture strength of 230 MPa and coated in the thickness of 0.2 mm with an insulation coating layer of olefin-based polymer to which magnesium hydroxide was added as the fire retardant.

A required amount of the fire retardant was determined through the following fire retardant property test and in compliance with ISO (International Standards Organization) 6722.

Figure 5:
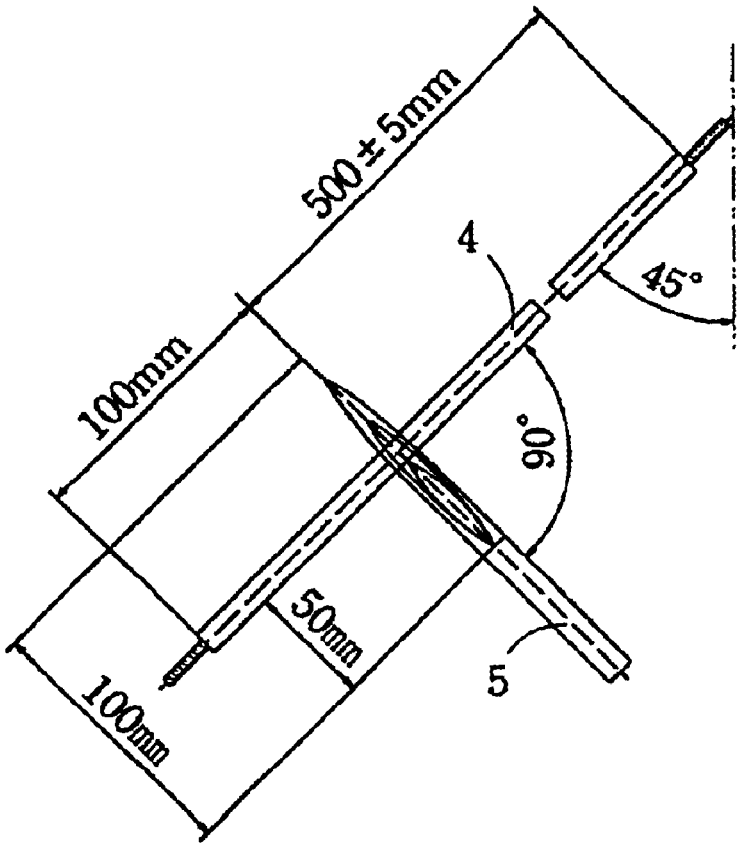
FIG. 5 is an explanatory diagram of the fire retardant property test.

That is, as shown in FIG. 5, a sample 4 having the length of 600 mm or longer was fixed at the angle of 45 degrees within an airless bath, and the amount of the fire retardant required for extinguishment within 70 seconds after burning the portion at 500 mm ±5 mm from the top end for 15 seconds using a Bunsen burner 5 was obtained.

Figure 4:
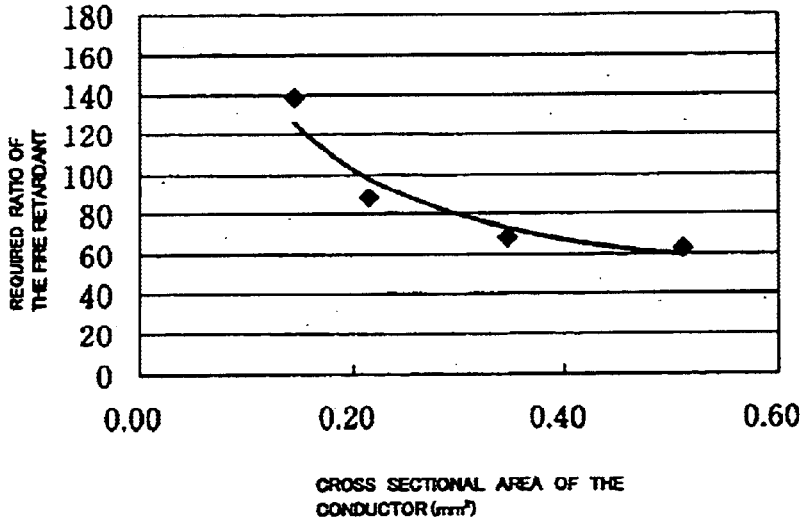
FIG. 4 is a graph which shows a relationship between the cross sectional area of the conductor and the required ratio of the fire retardant.

Table 1 and FIG. 4 show the result of the experiment. The ratio of the fire retardant in Table 1 is weight % of the fire retardant relative to the olefin-based polymer.

TABLE 1

| The cross sectional area of the conductor ($mm^2$) | The ratio of the fire retardant (weight %) |
|---|---|
| 0.5107 | 65 |
| 0.3464 | 70 |
| 0.2138 | 90 |
| 0.1431 | 140 |

As seen in FIG. 4, even as for the conductor having the same structure and the same material, the smaller the diameter of the conductor is, the larger the required amount of the fire retardant becomes, and the smaller the diameter of the conductor is, the larger the rate of change is.

Next, the required amount of the fire retardant in the structure of the electric wire according to various exemplary embodiments of the invention has also been examined.

The experiment used an electric wire coated in the thickness of 0.2 mm with an insulation coating layer of olefin-based polymer to which magnesium hydroxide was added as the fire retardant, in which SUS 304 having the cross sectional area of 0.0343 $mm^2$, and the tensile fracture strength of 940 MPa was used as a central element wire. Pure copper having the cross sectional area of 0.1057 $mm^2$ and the tensile fracture strength of 230 MPa was used as the peripheral element wires.

The result of the experiment was that the required ratio of the fire retardant, i.e., the required amount of fire retardant relative to the insulation polymer, was 160 weight % for the cross sectional area of the conductor of 0.14 $mm^2$, the tensile breaking load of the conductor was 63 N and the terminal fixing power was 50.4 N A similar experiment was conducted while changing the cross sectional area of the conductor. It was found that, although more amount of the fire retardant is required in various exemplary embodiments of the invention than in a conventional electric wire, because stainless steel is used as the central element wire, if 160 weight parts or more of the fire retardant is used relative to 100 weight parts of the insulation polymer, an electric wire according to the invention can satisfy the fire retardant property required for an electric wire for automobile.

Examples of various exemplary embodiments of the invention and a Reference Example will now be described. The embodiments of the invention, however, are not limited to the following examples. The examples below may be modified in various manners to the same and equivalent extent as various exemplary embodiments of the invention.

EXAMPLE 1

SUS 304 having the cross sectional area of 0.0314 $mm^2$ and the tensile fracture strength of 957 MPa was used as a central element wire before compression, and pure copper having the cross sectional area of 0.1321 $mm^2$ and the tensile fracture strength of 240 MPa was used as peripheral element wires before compression. Seven such peripheral element wires were arranged in a single circle in tight adherence with each other around the central element wire, they were compressed using dies, thereby obtaining a conductor having the cross sectional area of 0.14 $mm^2$.

Then, insulation coating was disposed by extrusion using as an insulation coating material a polyolefin compound in which 160 weight parts of magnesium hydroxide was added to 100 weight parts of olefin-based polymer, whereby the electric wire for automobile according to various exemplary embodiments of the invention was obtained. The tensile breaking load of thus fabricated electric wire was 59 N and the terminal fixing power was 47 N. The result of the fire retardant property test was within the standard.

EXAMPLE 2

SUS 304 having the cross sectional area of 0.0398 $mm^2$ and the tensile fracture strength of 949 MPa was used as a central element wire before compression, and pure copper having the cross sectional area of 0.1231 $mm^2$ and the tensile fracture strength of 245 MPa was used as peripheral element wires before compression. Eight such peripheral element wires were arranged in a single circle in tight adherence with each other around the central element wire, they were compressed using dies, thereby obtaining a conductor having the cross sectional area of 0.14 $mm^2$.

Then, insulation coating was disposed by extrusion using as an insulation coating material a polyolefin compound in which 160 weight parts of magnesium hydroxide was added to 100 weight parts of olefin-based polymer, whereby the electric wire for automobile according to various exemplary embodiments of the invention was obtained. The tensile breaking load of thus fabricated electric wire was 65 N and the terminal fixing power was 52 N. The result of the fire retardant property test was within the standard.

REFERENCE EXAMPLE

Pure copper having the cross sectional area of 0.0241 $mm^2$ and the tensile fracture strength of 235 MPa was used as a central element wire before compression, and pure copper having the cross sectional area of 0.1443 $mm^2$ and the tensile fracture strength of 245 MPa was used as peripheral element wires before compression. Seven such peripheral element wires were arranged in a single circle in tight adherence with each other around the central element wire, they were compressed using dies thereby obtaining a conductor having the cross sectional area of 0.14 $mm^2$, and insulation coating was disposed by extrusion using as an insulation coating material a polyolefin compound in which 140 weight parts of magnesium hydroxide was added to 100 weight parts of olefin-based polymer, whereby the electric wire for automobile according to various exemplary embodiments of the invention was obtained. The tensile breaking load of thus fabricated electric wire was 34 N and the terminal fixing power was 27 N. The result of the fire retardant property test was within the standard.

The electric wire for automobile according to various exemplary embodiments of the invention satisfies the current demand for a smaller diameter and an improved tensile strength almost to a practical limit. In addition, it is the electric wire for automobile wherein the heat generation problem is prevented by setting the amount of a fire retardant in a proper range.

While the invention has been described in conjunction with exemplary embodiments, these embodiments should be viewed as illustrative, not limiting. Various modifications, substitutions, or the like are possible within the spirit and scope of the invention.

What is claimed is:

1. An electric wire for automobile comprising:

a compressed conductor including:

a single central element wire of stainless steel;

seven or more peripheral element wires of copper or copper alloy in a single circle in tight adherence with each other disposed around the single central element wire; and an insulation coating layer which covers the outer circumference of the conductor, wherein a diameter of the central element wire is larger than diameters of the peripheral element wires, a cross sectional area of the conductor is 0.13 through 0.16 $mm^2$, and the insulation coating layer contains a fire retardant in the amount of 160 weight parts or more relative to 100 weight parts of insulation polymer.

2. The electric wire for automobile according to claim 1, wherein the cross sectional area of the conductor is a nominal cross sectional area of the conductor that is 0.13 $mm^2$.

* * * * *